US007862203B2

(12) United States Patent
Tu et al.

(10) Patent No.: US 7,862,203 B2
(45) Date of Patent: Jan. 4, 2011

(54) LIGHTING ASSEMBLY

(75) Inventors: Hsi-Ku Tu, Taipei Hsien (TW); Sheng-Ping Hou, Taipei Hsien (TW); Pin-Chun Chen, Taipei Hsien (TW)

(73) Assignee: Edison Opto Corporation, Taipei Hsien (TW)

( * ) Notice: Subject to any disclaimer, the term of this patent is extended or adjusted under 35 U.S.C. 154(b) by 569 days.

(21) Appl. No.: 11/889,150

(22) Filed: Aug. 9, 2007

(65) Prior Publication Data

US 2009/0040758 A1 Feb. 12, 2009

(51) Int. Cl.
*F21V 5/00* (2006.01)

(52) U.S. Cl. ..... 362/244; 362/240; 362/249.02; 362/311.06

(58) Field of Classification Search ..... 362/240, 362/244, 249.01, 249.02, 249.06, 645, 657–659, 362/311.06
See application file for complete search history.

(56) References Cited

U.S. PATENT DOCUMENTS 6,113,248 A * 9/2000 Mistopoulos et al. ..... 362/240
7,273,299 B2 * 9/2007 Parkyn et al. ..... 362/249.01

* cited by examiner

*Primary Examiner*—Stephen F Husar
(74) *Attorney, Agent, or Firm*—Birch, Stewart, Kolasch & Birch, LLP

(57) ABSTRACT

A lighting assembly is adapted to be connected to at least one conductive connection hole of an illumination device. The lighting assembly comprises at least one lighting cell and connection mechanism, wherein the lighting cell comprises a base, at least one electrical connector and a lighting unit. The electrical connector and the lighting unit are connected to the base, and electrically connected with each other. The lighting unit has a plurality of lighting circuits linearly arranged thereon, and one end of the connection mechanism is electrically connected to the electrical connector. When the lighting assembly only comprises one lighting cell, the other end of the connection mechanism is connected to the electrode connection hole; while when the lighting assembly comprises a plurality of said lighting cells, the other end of the connection mechanism is selectively connected to the conductive connection hole and the other electrical connector of the neighbor lighting cell.

11 Claims, 10 Drawing Sheets

LIGHTING ASSEMBLY

FIELD OF THE INVENTION

The present invention relates to a lighting assembly, and more particularly to a lighting assembly, which is composed of at least one lighting cell being capable of selectively and linearly connecting to an illumination device.

BACKGROUND OF THE INVENTION

With respect to the conventional illumination tools, such as incandescent lamps, halogen light tubes or fluorescent lamps, light emitting diodes (LEDs) are a kind of compound semiconductors having the advantages of less volume, fast respondence, long working life, lower illumination-reduction, rigid surfaces, anti-vibration, full-color light, being convenient to execute light-directionality design, lower voltage, lower current, lower transformation loss, lower heat radiation, simple mass-production, environment protection, etc.

Due to above advantages and the versatile applications, LED is getting more and more popular by light designers and consumers. Therefore, since the white LED is presented to the public, the application of LED has obviously grown up. Presently, the technology of the white LED has being fully developed worldwide so as to make that the conventional lights for home usages, mobile phones, advertisements, signs, etc. are gradually replaced.

With reference to FIG. 1 and FIG. 2, wherein FIG. 1 illustrates an exploded view of an LED light device made in prior arts, and FIG. 2 illustrates a sectional view of the LED light device made in prior arts. As shown in the figures, an LED light device 100 includes a shade 10 and a lighting assembly 20, wherein the lighting assembly 20 further includes a base 21, a printed circuit board (PCB) 22 electrically connecting to the base 21, a plurality of connecting bases 23 fixed on and electrically connected to the PCB 22, and a plurality of LEDs 24 correspondingly disposed to the connecting bases 23, the LEDs 24 are capable of inserting into and drawing out from the connecting bases 23, each connecting base 23 has a plurality of terminals 26 for a plurality of prongs 25 of the LEDs 24 respectively inserting in.

According the practice necessary, the shape of the shade 10 can be round, triangle, quadrangle, irregular, etc. For the lighting assembly 20, a connector 27 connects the base 21 and the PCB 22. The LEDs 24 and the terminals 26 the LEDs 24 are buckled or welded together so as to make them electrically connect with each other.

However, to design a conventional LED light device, it is necessary to mount LEDs on the connecting base, so as to be fitted for the PCB in the base. Being limited by the design of the PCB, the conventional LED light device is hardly made with respect to different environment, so that the application of the conventional LED light device is degraded.

Additionally, the most of the conventional LED light devices are made in a way that one connecting base corresponding to one LED. Therefore, when the conventional LED light devices are served to provide large-area illumination, the design of the PCB must be complicated, the assembling of the LED light device must be more difficult, and the variability of the assembling must be limited, too.

SUMMARY OF THE INVENTION

The objective of the Present Invention Are Described As Follows:

The primary objective of the present invention is to provide a lighting assembly by assembling at least one connection mechanism and at least one lighting cell. Through the variability of the connection method between the connection mechanism(s) and the lighting cell(s), the light assembly can be assembled to present in many kinds.

Means of the Present Invention for Solving Problems:

Means of the present invention for solving the problems as mentioned above provides a lighting assembly adapted to be connected to at least one conductive connection hole of an illumination device. The lighting assembly comprises at least one lighting cell and at least one connection mechanism. The lighting cell comprises a base, at least one electrical connector and a lighting unit. The electrical connector and the lighting unit are connected to the base, and electrically connected with each other. The lighting unit has a plurality of lighting circuits linearly arranged thereon, the lighting circuit is made by connecting a plurality of LEDs, and one end of the connection mechanism is electrically connected to the electrical connector.

When the lighting assembly only comprises one lighting cell, the other end of the connection mechanism is connected to the electrode connection hole; while when the lighting assembly comprises two or more of said lighting cells, the other end of the connection mechanism is selectively connected to the conductive connection hole and the other electrical connector of the neighbor lighting cell.

Effects of the Present Invention with Respect to Prior Arts:

With the difference between the prior arts and the present invention, the lighting assembly as provided in accordance with the present invention not only can provide sufficient illumination, but also can make the lighting assembly be conveniently assembled to a fixture of an illumination device via the connection mechanism. Nevertheless, through the selection of the connection methods of the connection mechanism(s) and the lighting cell(s), the lighting circuits can be electrically connected in a way of a parallel connection, a series connection, and both the parallel connection and the series connection, so as to advance the convenience and the variability of assembling the illumination device.

The devices, characteristics, and the preferred embodiment of this invention are described with relative figures as follows.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Due to that the lighting assembly as provided in accordance with the present invention can be widely applied to many kinds of light devices, the combined applications are too numerous to be enumerated and described, so that on the basis of the structure, only a preferred embodiment and three applications are disclosed as follows for representation.

Figure 1:
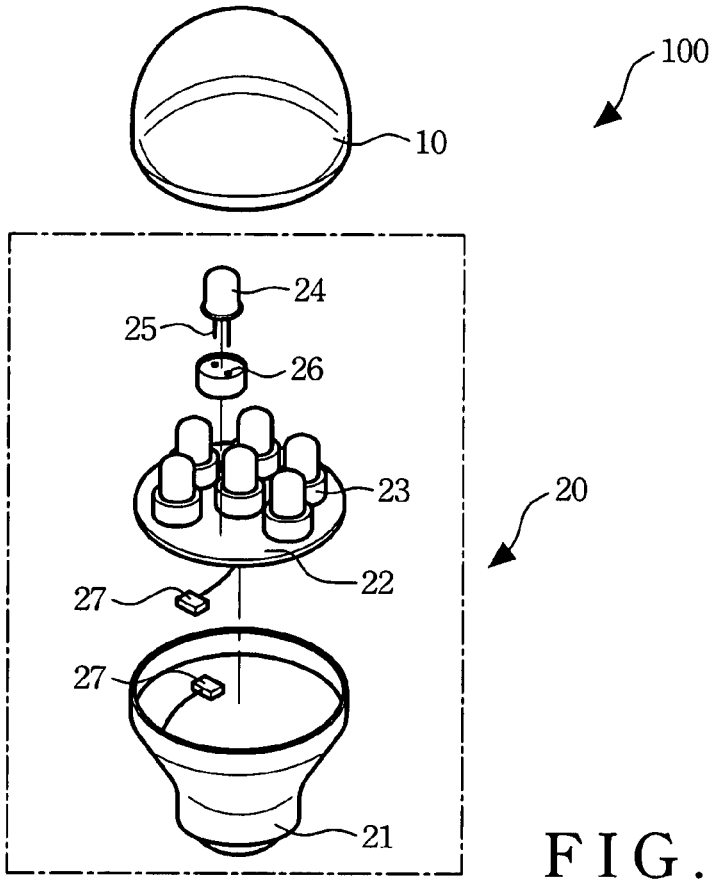
FIG. 1 (Prior Art)
FIG. 1 illustrates an exploded view of an LED light device made in prior arts.
Figure 2:
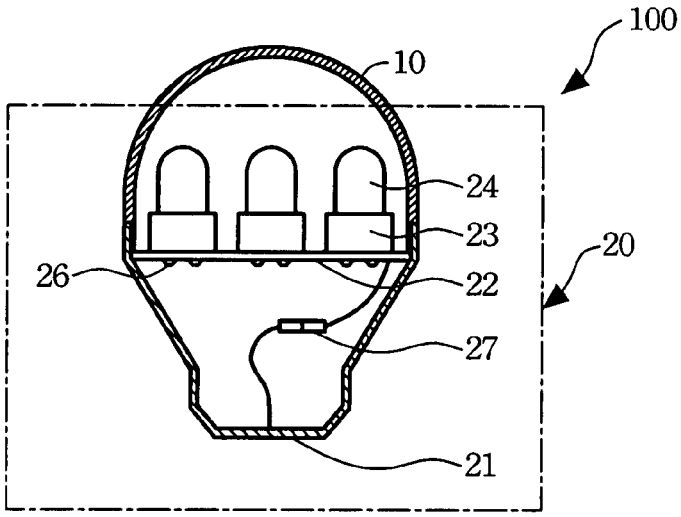
FIG. 2 (Prior Art)
FIG. 2 illustrates a sectional view of the LED light device made in prior arts.
Figure 3:
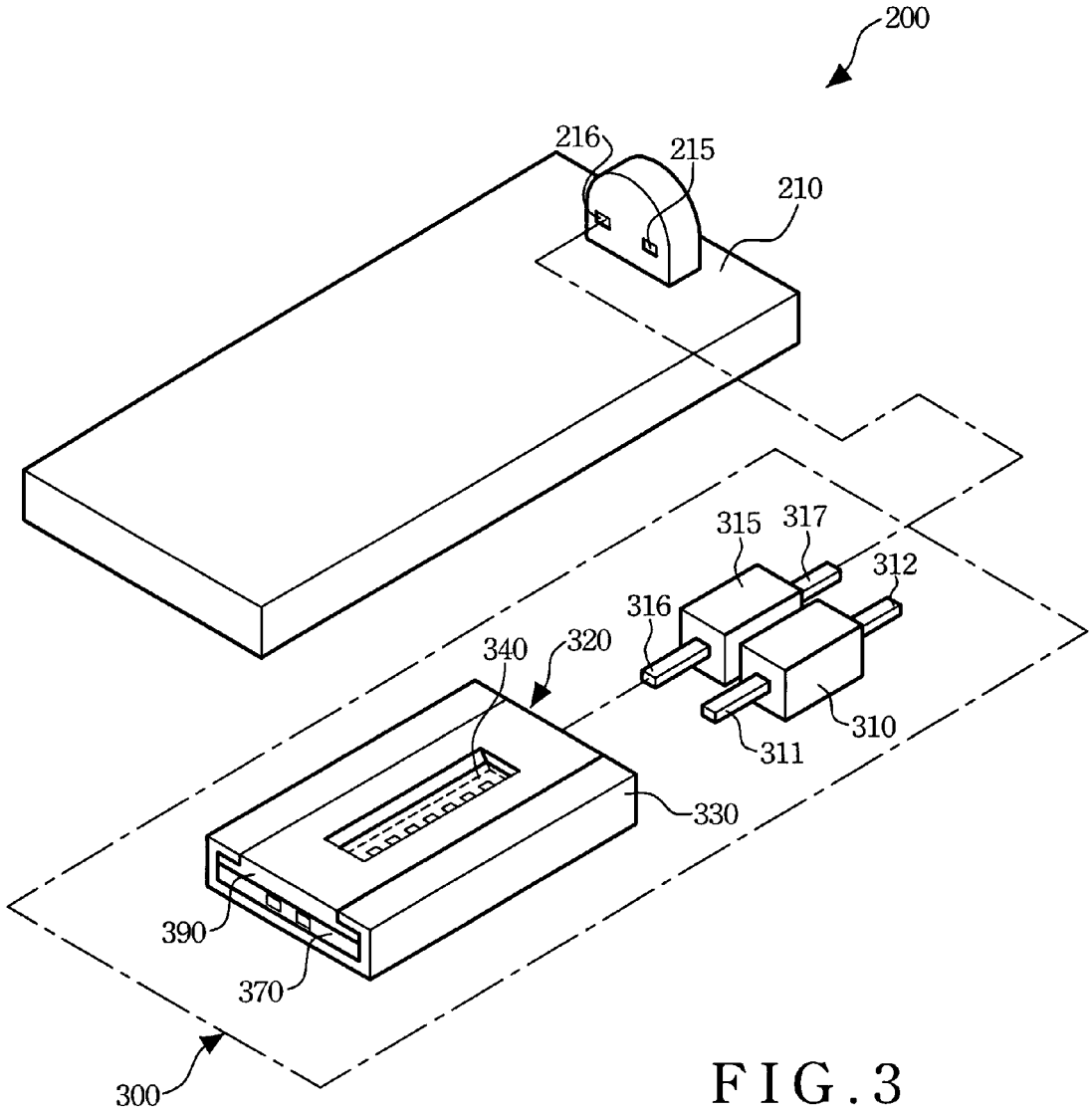
FIG. 3 is an exploded view of a preferred embodiment of the present invention illustrating a lighting cell can be connected to a fixture of an illumination device via the connection mechanism.

Please refer to FIG. 3, which is an exploded view of a preferred embodiment of the present invention illustrating a lighting cell can be connected to a fixture of an illumination device via the connection mechanism. As shown in FIG. 3, an illumination device 200 comprises a fixture 210, and the fixture 210 has a pair of conductive connection holes 215 and 216. A lighting assembly 300 is electrically connected to the conductive connection holes 215 and 216, so as to project out an illumination light beam.

The lighting assembly 300 comprises two connection mechanisms 310, 315 and a lighting cell 320. Two end surfaces of the connection mechanism 310 have a first electrode contact 311 and a second electrode contact 312 respectively. Similarly, two end surfaces of the connection mechanism 315 have a first electrode contact 316 and a second electrode contact 317 respectively. The electrode contacts 312 and 317 are respectively connected to the conductive connection holes 215 and 216, and the electrode contacts 311 and 316 are connected to the lighting cell 320.

Figure 4:
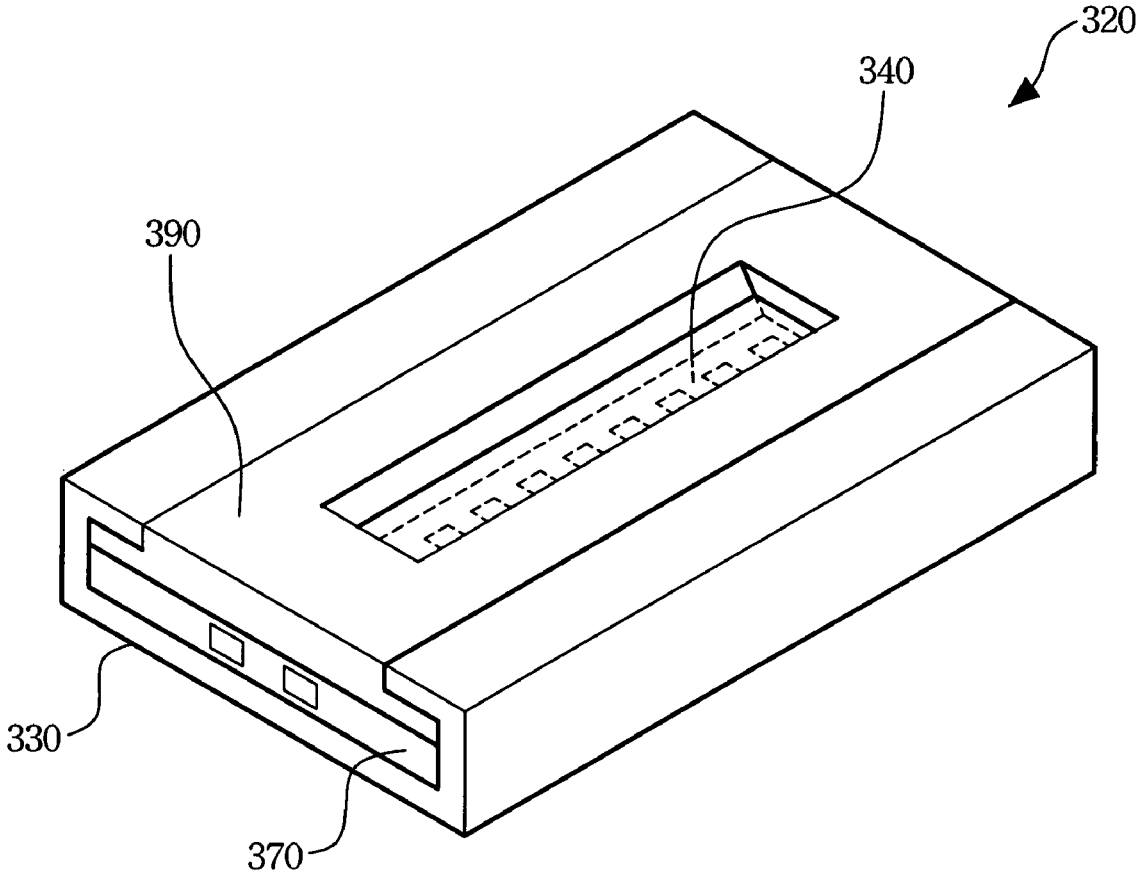
FIG. 4 is a perspective view illustrating the lighting cell in accordance with the preferred embodiment of the present invention.
Figure 5:
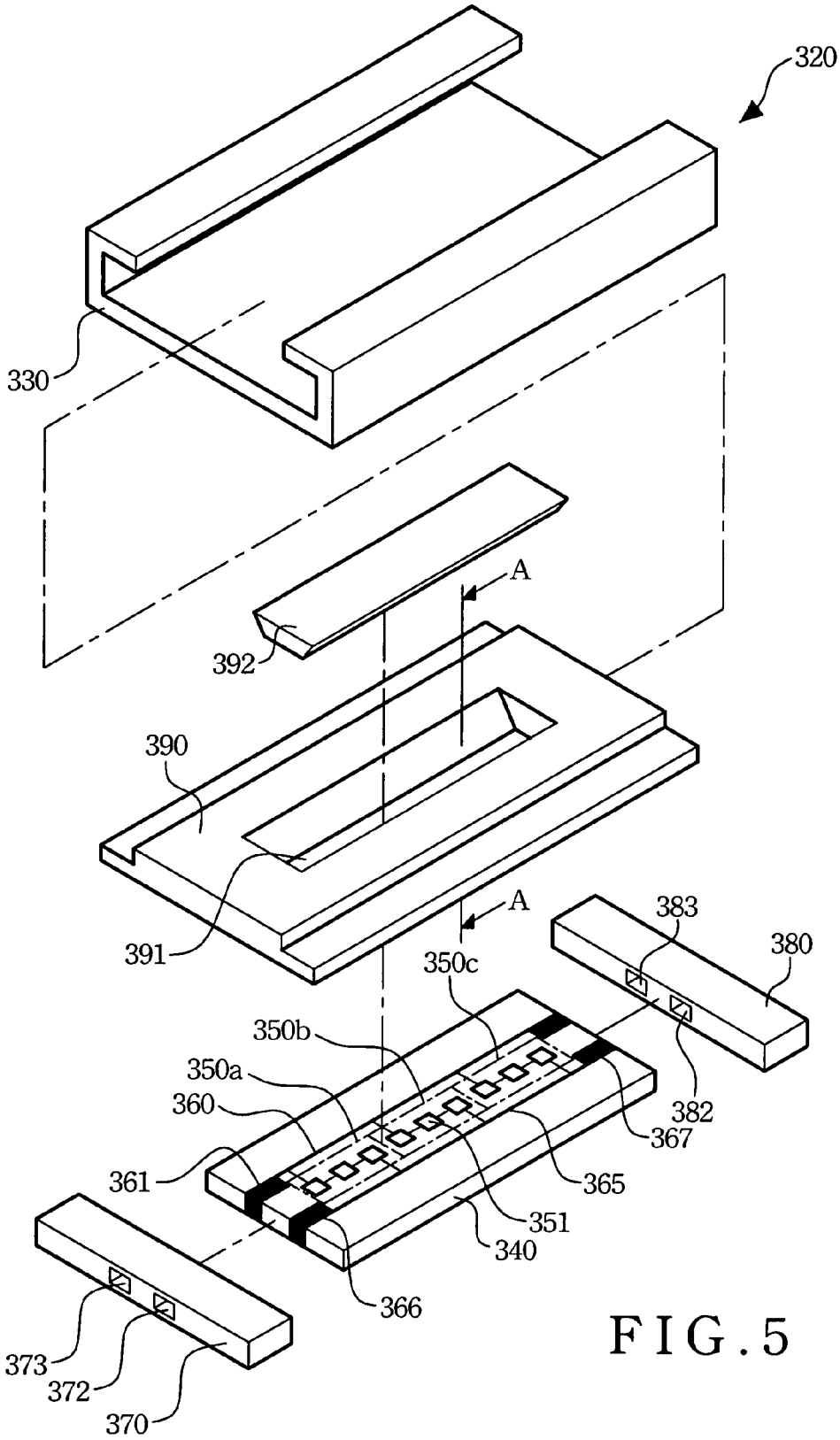
FIG. 5 is an exploded view of the lighting cell in accordance with the preferred embodiment of the present invention.
Figure 5A:
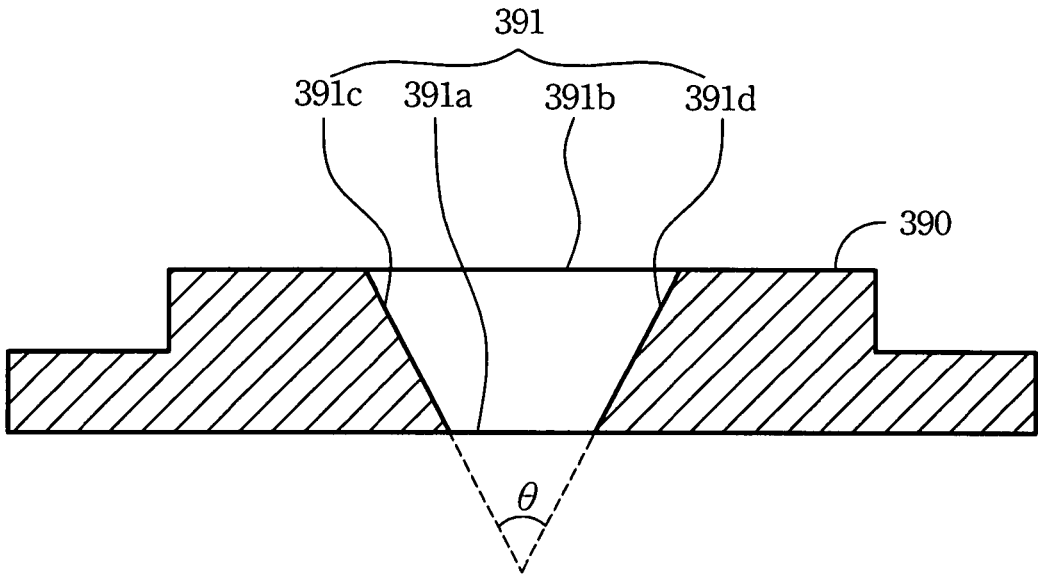
FIG. 5A is a section view along the A-A direction of FIG. 5.

The structure of the lighting cell 320 can be illustrated from FIG. 4 to FIG. 5A, wherein FIG. 4 is a perspective view illustrating the lighting cell, FIG. 5 is an exploded view of the lighting cell in accordance with the preferred embodiment of the present invention, and FIG. 5A is a section view along the A-A direction of FIG. 5 in accordance with the preferred embodiment of the present invention. As shown in the figures, the lighting cell 320 comprises a base 330, a lighting unit 340, two electrical connectors 370, 380, and an upper cover 390, wherein the base 330 is formed in an u-shape alike cross section, and the base 330 comprises a heat-dissipating structure (not shown) composed of heat-dissipating material.

The lighting unit 340 is deposited within the base 330 neighbor to the bottom of the u-shape alike cross section, and comprises three lighting circuits 350*a*, 350*b*, 350*c*, arranged linearly, and two conductive lines 360 and 365. Two end surfaces of the lighting unit 340 respectively have a pair of first conductive terminals 361, 366, and a pair of second conductive terminals 362 and 367. Each one of the three lighting circuits 350*a*, 350*b* and 350*c* comprises three LEDs 351 connected in series. Thus, nine LEDs 351 are linearly arranged, moreover, each one of the lighting circuits 350*a*, 350*b* and 350*c* is connected in parallel with each other between the two conductive lines 360 and 365.

The electrical connectors 370 and 380 are electrically connected to two end surfaces of the lighting unit 340 respectively, and the electrical connectors 370 and 380 are deposited within the base 330 together with the lighting unit 340. One end surface of the electrical connector 370 has two electrode connection holes 372 and 373, the other end surface of the electrical connector 370 has two electrode connection holes 376 and 377 (shown in FIG. 6), and the two electrode connection holes 372 and 373 are electrically connected to the two electrode connection holes 376 and 377. Similarly, one end surface of the electrical connector 380 has two electrode connection holes 382 and 383, the other end surface of the electrical connector 30 has two electrode connection holes 386 and 387 (shown in FIG. 6), and the two electrode connection holes 382 and 383 are electrically connected to the two electrode connection holes 386 and 387.

The upper cover 390 is applied to cover the electrical connectors 370, 380 and the lighting unit 340. A transparent region 391 of the upper cover is linearly extended with respect to the lighting unit 340. The transparent region 391 is formed in a trapezoid cross section, which is composed of a short base 391*a* near the lighting unit 340, a long base 391*b* parallel to the short base and far away from the lighting unit 340, and two hypotenuses 391*c* and 391*d* located between the short base 391*a* and the long base 391*b*. The distance between the two hypotenuses 391*c* and 391*d* are linearly increased from the short base 391*a* to the long base 391*b*, and the two hypotenuses 391*c* and 391*d* are extended to form a light-emitting angle θ. Moreover, the upper cover 390 further comprises a transparent element 392 embedded in the transparent region 391 to make the upper cover 390 package the lighting unit 340 together with the base 330.

Figure 6:
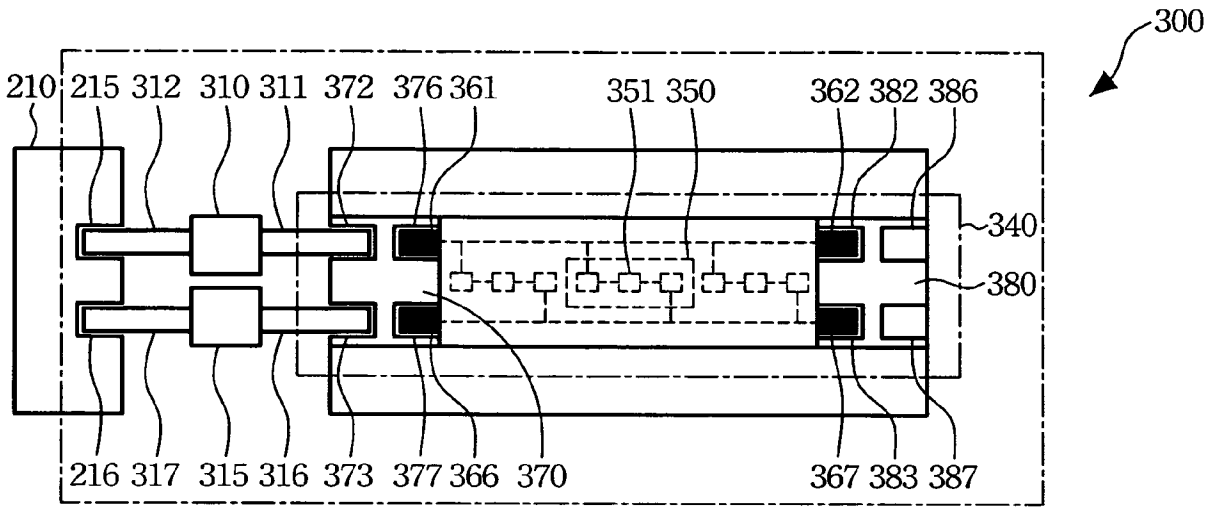
FIG. 6 illustrates a general structure after the lighting assembly is connected to the fixture of the illumination device.
Figure 7:
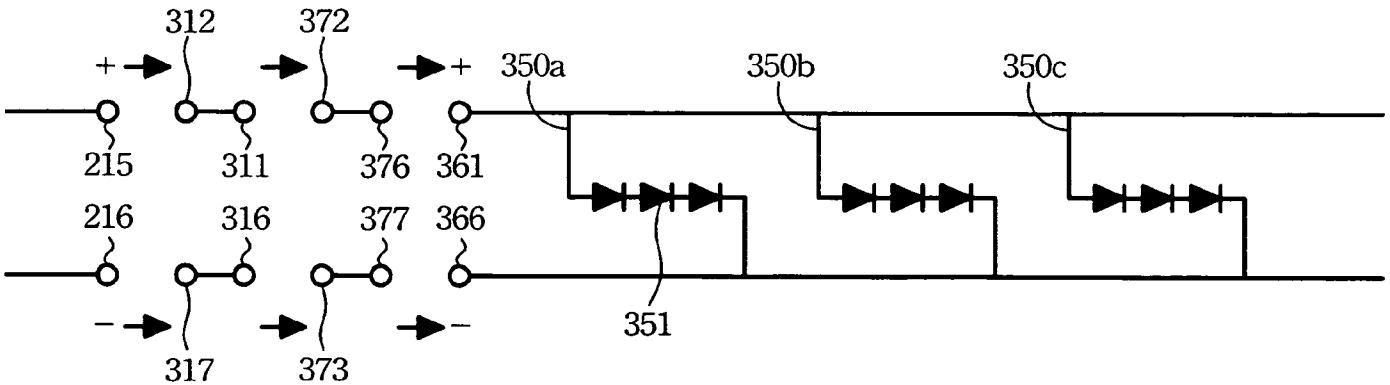
FIG. 7 illustrates a simplified circuit diagram after the lighting assembly is connected to the fixture of the illumination device.

Please refer to FIG. 6 and FIG. 7, wherein FIG. 6 illustrates a general structure after the lighting assembly is connected to the fixture of the illumination device, and FIG. 7 illustrates a simplified circuit diagram after the lighting assembly is connected to the fixture of the illumination device. As shown in the figures, when the lighting assembly 300 is connected to the fixture 210 of the illumination device 200, the electrode contact 311 of the connection mechanism 310 is connected to the electrode connection hole 372 of the electrical connector 370, and the electrode contact 312 of the connection mechanism 310 is connected to the conductive connection hole 215; similarly, the electrode contact 316 of the connection mechanism 315 is connected to the electrode connection hole 373 of the electrical connector 370, and the electrode contact 317 of the connection mechanism 315 is connected to the conductive connection hole 216.

Under above connection relations, when an external power source (not shown) supplies a working power to the lighting circuits 350*a*, 350*b* and 350*c* within the lighting unit 340, the nine LEDs 351 can be driven to project nine illumination light beams. Meanwhile, because the transparent region 391 is linearly extended, and the nine LEDs 351 are linearly arranged, the nine illumination light beams are linearly distributed when they are projected out through the transparent region 391, so as to provide linear-extended illumination to external environment.

People skilled in ordinary arts can easily realize that, in practice applications, for meeting many different requirements of illumination, the rake of the two hypotenuses 391*c* and 391*d* can be adjusted when designing the dimension specification of the transparent region 391, so as to adjust the light-emitting angle θ. Furthermore, the transparent element 392 can be provided with many specified optical functions, such as light-concentration, light-divergence, anti-glaring, etc., so as to meet many different illumination requirements. Therefore, the nine illumination light beams can be modulated to change the illumination value, the illumination area, or to provide non-glaring soft illumination. Nevertheless, the lighting assembly not only can provide illumination, but also has a basic heat-dissipating function due to that the base 330 comprises the heat-dissipating structure composed of heat-dissipating material.

For further explaining the lighting assembly having the characteristic of being capable of selectively linear connection, and having strong commercial values, three applications in accordance with the preferred embodiment of the present invention will be disclosed as follows to illustrate that the lighting assembly can be made by many connection methods of the connection mechanism(s) and the lighting cells, so as to present different kinds of performance and appearance. Meanwhile, through different connection methods, the lighting circuits within the lighting cells can be electrically connected in one way of a parallel connection, a series connection, and both the parallel connection and the series connection.

Figure 8:
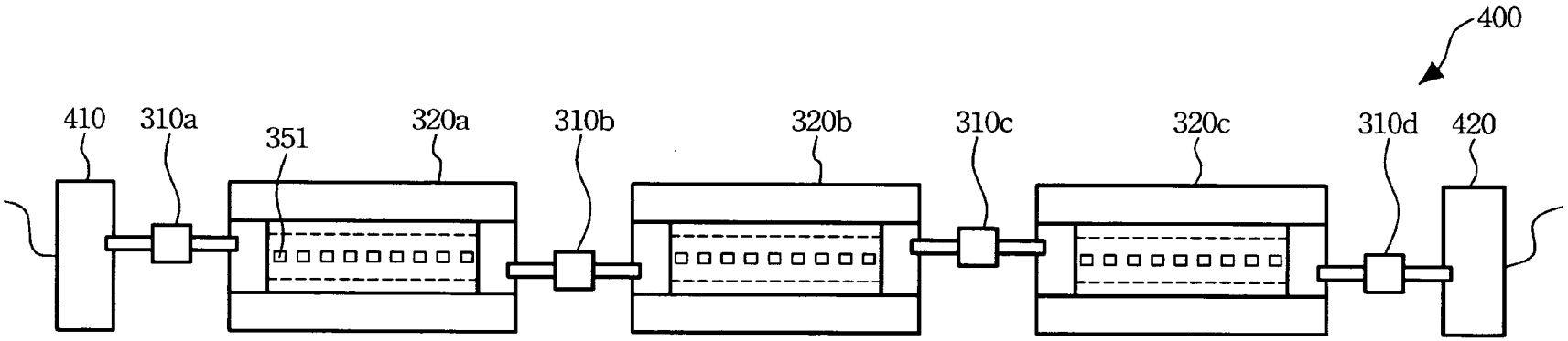
FIG. 8 illustrates a connection method in accordance with a first application of the preferred embodiment of the present invention.
Figure 9:
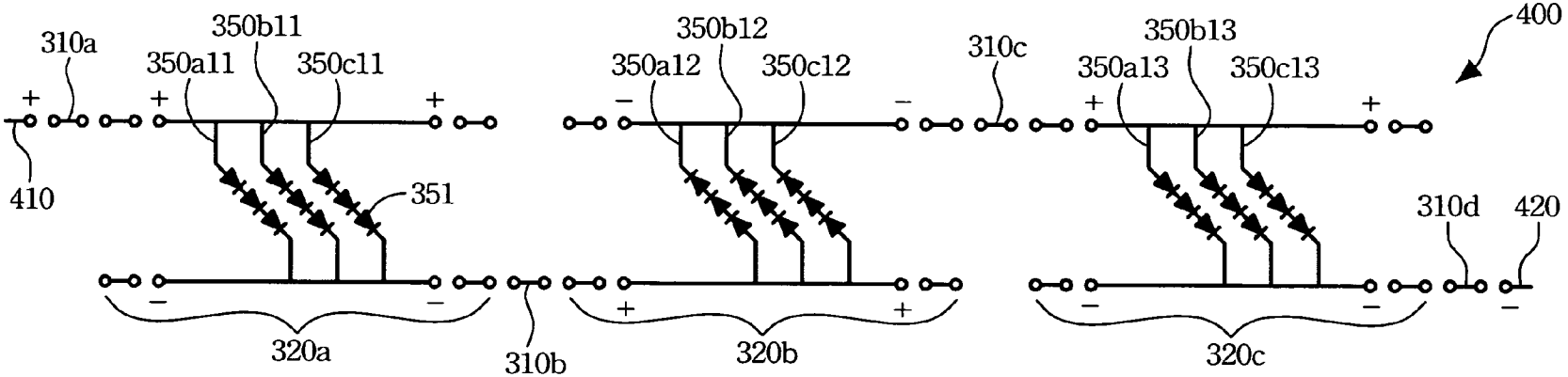
FIG. 9 illustrates a simplified circuit diagram in accordance with the first application of the preferred embodiment of the present invention.

Please refer to FIG. 8 and FIG. 9, wherein FIG. 8 illustrates a connection method in accordance with a first application of the preferred embodiment of the present invention, and FIG. 9 illustrates a simplified circuit diagram in accordance with the first application of the preferred embodiment of the present invention. Simultaneously, please compare FIG. 8 and FIG. 9 with FIG. 6 and FIG. 7. As shown in the figures, a lighting assembly 400 is composed of three lighting cells 320*a*, 320*b*, 320*c*, and four connection mechanisms 310*a*, 310*b*, 310*c* and 310*d*.

The lighting cell 320*a* comprises three lighting circuits 350*a*11, 350*b*11 and 350*c*11, the lighting cell 320*b* comprises three lighting circuits 350*a*12, 350*b*12 and 350*c*12, and the lighting cell 320*c* comprises three lighting circuits 350*a*13, 350*b*13 and 350*c*13. The structure and the function of lighting cells 320*a*, 320*b* and 320*c* are similar to or the same as that of the lighting cell 320, except for that the forward bias direction of the lighting circuits 350*a*12, 350*b*12 and 350*c*12 of the lighting cell 320*b* is opposite to that of the lighting circuits 350*a*, 350*b* and 350*c* of the lighting cell 320.

The connection mechanism 310*a* is connected to a power-connected end 410 and a positive electrode of an electrical connector (with the structure the same as the electrical connector 370 as shown in FIG. 6) of the lighting cell 320*a*. The connection mechanism 310*b* is connected to a negative electrode of the other electrical connector (with the structure the same as the electrical connector 380 as shown in FIG. 6) of the lighting cell 320*a* and a negative electrode of an electrical connector (with the structure the same as the electrical connector 370 as shown in FIG. 6) of the lighting cell 320*b*. The connection mechanism 310*c* is connected to a positive electrode of the other electrical connector (with the structure the same as the electrical connector 380 as shown in FIG. 6) of the lighting cell 320*b* and a positive electrode of an electrical connector (with the structure the same as the electrical connector 370 as shown in FIG. 6) of the lighting cell 320*c*. The connection mechanism 310*d* is connected to a negative electrode of the other electrical connector (with the structure the same as the electrical connector 380 as shown in FIG. 6) of the lighting cell 320*c* and the other power-connected end 420.

Thus, in structural, the lighting cells 320*a*, 320*b* and 320*c* are linearly connected. In the view of the circuits, the lighting circuits 350*a*11, 350*b*11 and 350*c*11 are electrically connected with the lighting circuits 350*a*12, 350*b*12 and 350*c*12 in a way of a series connection, and are further electrically connected with the lighting circuits 350*a*13, 350*b*13 and 350*c*13 in the way of the series connection, too.

Figure 10:
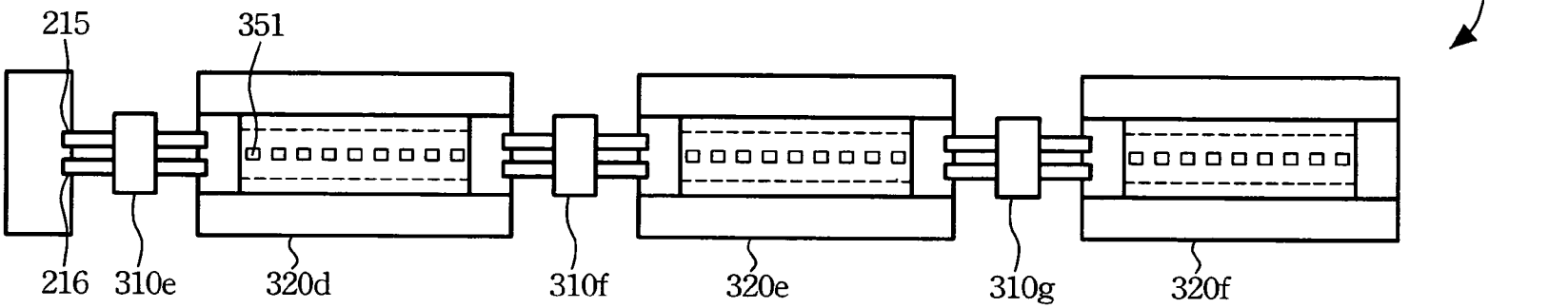
FIG. 10 illustrates a connection method in accordance with a second application of the preferred embodiment of the present invention;.
Figure 11:
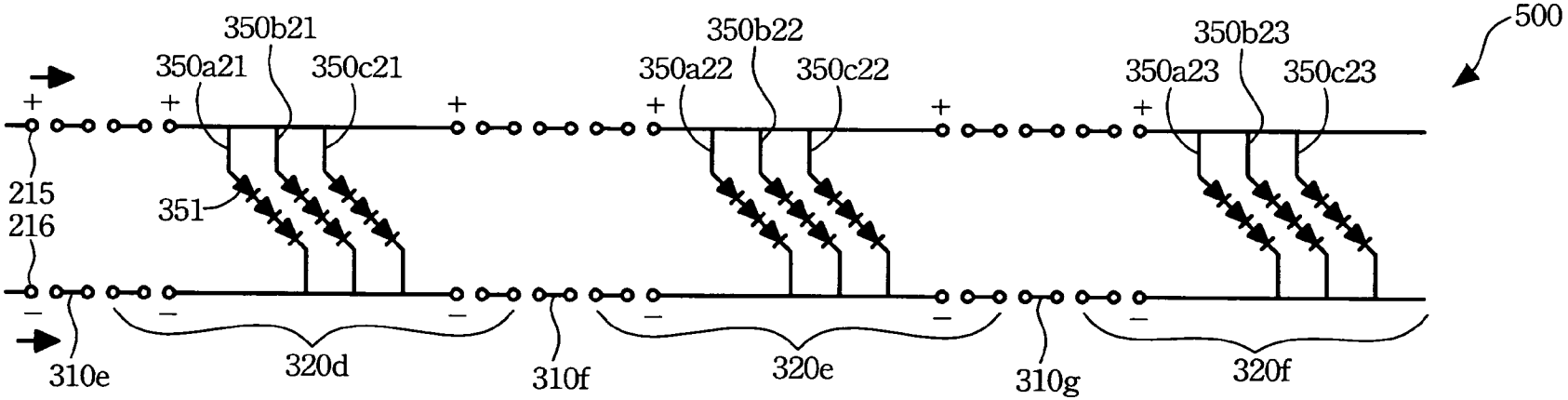
FIG. 11 illustrates a simplified circuit diagram in accordance with the second application of the preferred embodiment of the present invention.

Please refer to FIG. 10 and FIG. 11, wherein FIG. 10 illustrates a connection method in accordance with a second application of the preferred embodiment of the present invention, and FIG. 11 illustrates a simplified circuit diagram in accordance with the second application of the preferred embodiment of the present invention. Simultaneously, please compare FIG. 10 and FIG. 11 with FIG. 6 and FIG. 7. As shown in the figures, a lighting assembly 500 is composed of three lighting cells 320*d*, 320*e*, 320*f*, and three connection mechanisms 310*e*, 310*f* and 310*g*.

The lighting cell 320*d* comprises three lighting circuits 350*a*21, 350*b*21 and 350*c*21, the lighting cell 320*e* comprises three lighting circuits 350*a*22, 350*b*22 and 350*c*22, and the lighting cell 320*f* comprises three lighting circuits 350*a*23, 350*b*23 and 350*c*23. In the second application, the structure and the function of lighting cells 320*d*, 320*e* and 320*f* are similar to or the same as that of the lighting cell 320. Meanwhile, the connection mechanisms 310 and 315 are combined into an integral part, so as to respectively make the three connection mechanisms 310*e*, 310*f* and 310*g*.

The connection mechanism 310*e* is connected to the conductive connection holes 215, 216 and a positive electrode of an electrical connector (with the structure the same as the electrical connector 370 as shown in FIG. 6) of the lighting cell 320*d*. The connection mechanism 310*f* is connected to the other electrical connector (with the structure the same as the electrical connector 380 as shown in FIG. 6) of the lighting cell 320*d* and an electrical connector (with the structure the same as the electrical connector 370 as shown in FIG. 6) of the lighting cell 320*e*. The connection mechanism 310*g* is connected to the other electrical connector (with the structure the same as the electrical connector 380 as shown in FIG. 6) of the lighting cell 320*e* and an electrical connector (with the structure the same as the electrical connector 370 as shown in FIG. 6) of the lighting cell 320*f*.

Thus, in structural, the lighting cells 320*d*, 320*e* and 320*f* are linearly connected. In the view of the circuits, the lighting circuits 350*a*21, 350*b*21 and 350*c*21 are electrically connected with the lighting circuits 350*a*22, 350*b*22 and 350*c*22 in a way of a parallel connection, and are further electrically connected with the lighting circuits 350*a*23, 350*b*23 and 350*c*23 in the way of the parallel connection, too.

Figure 12:
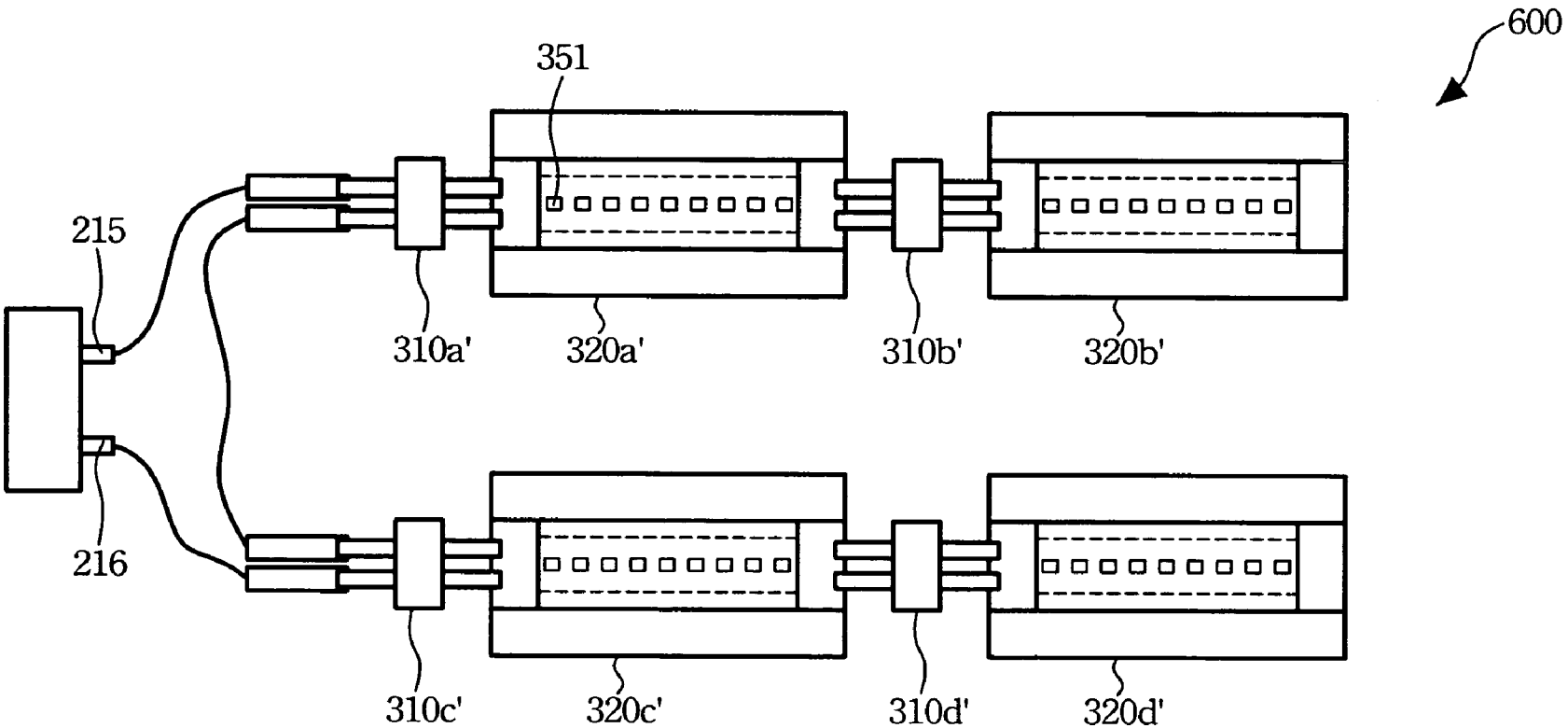
FIG. 12 illustrates a connection method in accordance with a third application of the preferred embodiment of the present invention.
Figure 13:
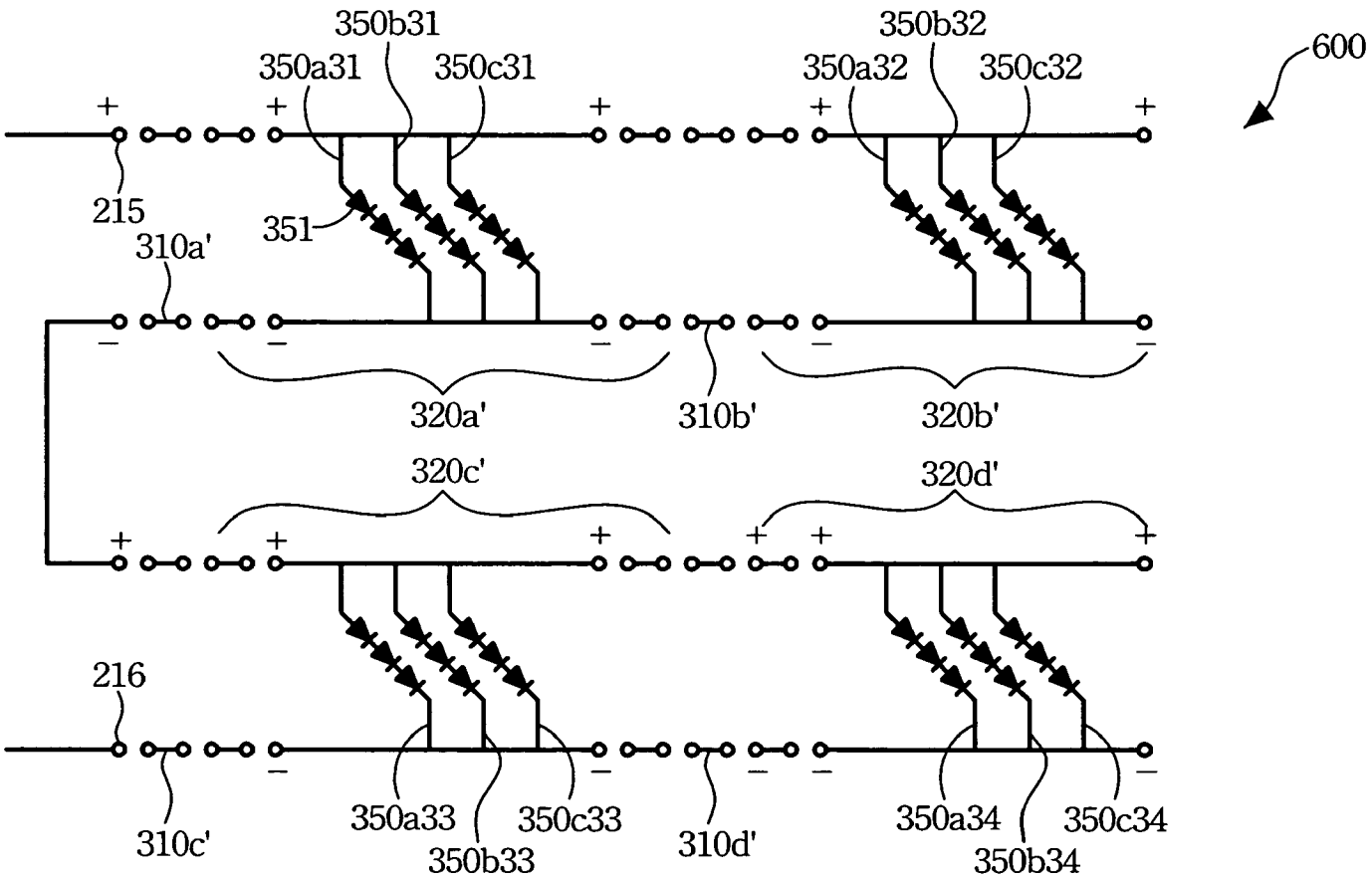
FIG. 13 illustrates a simplified circuit diagram in accordance with the third application of the preferred embodiment of the present invention.

Please refer to FIG. 12 and FIG. 13, wherein FIG. 12 illustrates a connection method in accordance with a third application of the preferred embodiment of the present invention, and FIG. 13 illustrates a simplified circuit diagram in accordance with the third application of the preferred embodiment of the present invention. Simultaneously, please compare FIG. 12 and FIG. 13 with FIG. 6 and FIG. 7. As shown in the figures, a lighting assembly 600 is composed of four lighting cells 320*a*', 320*b*', 320*c*', 320*d*' and four connection mechanisms 310*a*', 310*b*', 310*c*' and 310*d*'.

The lighting cell 320*a*' comprises three lighting circuits 350*a*31, 350*b*31 and 350*c*31, the lighting cell 320*b*' comprises three lighting circuits 350*a*32, 350*b*32 and 350*c*32, the lighting cell 320$c'$ comprises three lighting circuits 350$a$33, 350$b$33 and 350$c$33, and the lighting cell 320$d'$ comprises three lighting circuits 350$a$34, 350$b$34 and 350$c$34. In the third application, the structure and the function of lighting cells 320$a'$, 320$b'$, 320$c'$ and 320$d'$ are similar to or the same as that of the lighting cell 320. Meanwhile, the connection mechanisms 310 and 315 are combined into an integral part, so as to respectively make the four connection mechanisms 310$a'$, 310$b'$, 310$c'$ and 310$d'$.

A positive electrode of the connection mechanism 310$a'$ is connected to the conductive connection hole 215 and an electrical connector (with the structure the same as the electrical connector 370 as shown in FIG. 6) of the lighting cell 320$a'$. A negative electrode of the connection mechanism 310$a'$ is connected to a positive electrode of the connection mechanism 310$c'$ and the electrical connector (with the structure the same as the electrical connector 370 as shown in FIG. 6) of the lighting cell 320$a'$. The connection mechanism 310$b'$ is connected to the other electrical connector (with the structure the same as the electrical connector 380 as shown in FIG. 6) of the lighting cell 320$a'$ and an electrical connector (with the structure the same as the electrical connector 370 as shown in FIG. 6) of the lighting cell 320$b'$. A negative electrode of the connection mechanism 310$c'$ is connected to the conductive connection hole 216 and an electrical connector (with the structure the same as the electrical connector 370 as shown in FIG. 6) of the lighting cell 320$c'$. The connection mechanism 310$d'$ is connected to the other electrical connector (with the structure the same as the electrical connector 380 as shown in FIG. 6) of the lighting cell 320$c'$ and an electrical connector (with the structure the same as the electrical connector 370 as shown in FIG. 6) of the lighting cell 320$d'$.

Thus, in structural, the lighting cells 320$a'$ and 320$b'$ are linearly connected, and the lighting cells 320$c'$ and 320$d'$ are also linearly connected, but the lighting cells 320$a'$ and 320$b'$ keeps abreast of the lighting cells 320$c'$ and 320$d'$. In the view of the circuits, the lighting circuits 350$a$31, 350$b$31 and 350$c$31 are electrically connected with the lighting circuits 350$a$32, 350$b$32 and 350$c$32 in a way of a parallel connection, and the lighting circuits 350$a$33, 350$b$33 and 350$c$33 are electrically connected with the lighting circuits 350$a$34, 350$b$34 and 350$c$34 in the way of the parallel connection; but the lighting circuits 350$a$31, 350$b$31, 350$c$31, 350$a$32, 350$b$32 and 350$c$32 are electrically connected with the lighting circuits 350$a$33, 350$b$33, 350$c$33, 350$a$34, 350$b$34 and 350$c$34 in a way of a series connection. Therefore, the twelve lighting circuits 350$a$31~350$c$34 are electrically connected in a way of both the parallel connection and the series connection.

After reading the description of the preferred embodiment and three applications of the present invention as disclosed, people skilled in ordinary arts can easily realize that, through many kinds of simple connection methods for connecting the lighting cells, the present invention can make the lighting circuits be connected in a way of a parallel connection, a series connection, and both the parallel connection and the series connection. Therefore, in commercial, the present really have versatile application values.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A lighting assembly being adapted to connect to at least one conductive connection hole of a fixture of an illumination device, and comprising:

at least one lighting cell, comprising:

a base;

at least one electrical connector connected to the base; and a lighting unit assembled to the base, electrically connected to the electrical connector, and comprising a plurality of lighting circuits arranged linearly;

an upper cover combined with the base to shield the electrical connector and the lighting unit, and having a transparent region located with respect to the lighting unit projecting out an illumination light beam therethrough;

at least one connection mechanism having one end electrically connected to the electrical connector of the lighting cell;

wherein the transparent region is formed in a trapezoid cross section composed of a short base near the lighting unit, a long base parallel to the short base and far away from the lighting unit, and two hypotenuses located between the short base and the long base; when the lighting assembly comprises only one said lighting cell, the other end of the connection mechanism is electrically connected to the conductive connection hole; and when the lighting assembly comprises a plurality of said lighting cells, a plurality of said connection mechanisms are applied in a way that the other end of at least one of said connection mechanisms is electrically connected to the conductive connection hole, and the other end of the rest of said connection mechanisms is electrically to the neighbor lighting cell.

2. The lighting assembly as claimed in claim 1, wherein the two hypotenuses are extended to formed a light-emitting angle.

3. The lighting assembly as claimed in claim 1, wherein the upper cover further comprises a transparent element embedded in the transparent region.

4. The lighting assembly as claimed in claim 1, wherein two end surfaces of the electrical connector have at least one electrode hole respectively.

5. The lighting assembly as claimed in claim 4, wherein the lighting unit further comprises two conductive lines, two ends of the lighting unit respectively have a pair of first conductive terminals and a pair of second conductive terminals, the two conductive lines are respectively extended from the first conductive terminals to the second conductive terminals, and at least one of the first conductive terminals and the second conductive terminals is connected to the electrode hole.

6. The lighting assembly as claimed in claim 4, wherein the lighting circuits are connected, in parallel, to the two conductive lines.

7. The lighting assembly as claimed in claim 1, wherein the lighting circuit comprises a plurality of light emitting diodes (LEDs) connected in series.

8. The lighting assembly as claimed in claim 1, wherein the two end surfaces of the connection mechanism have at least one electrode contact respectively, and two end surfaces of the electrical connector have at least one electrode hole respectively.

9. The lighting assembly as claimed in claim 8, wherein when the lighting assembly comprises a plurality of said lighting cells, a plurality of said connection mechanisms are applied, the electrode contact in one of the two end surfaces of at least one of said connection mechanisms is connected to the conductive connection hole, and the electrode contact of the rest of said connection mechanisms is connected to the electrode hole.

10. The lighting assembly as claimed in claim 9, wherein when the light assembly comprises a plurality of said lighting cell, the lighting cells are connected by the connection mechanism, so as to make the lighting circuits within the lighting cells electrically connected in one way of a parallel connection, a series connection, and both the parallel connection and the series connection.

11. The lighting assembly as claimed in claim 9, wherein when the light assembly comprises a plurality of said lighting cell, the lighting cells are connected by the connection mechanism, so as to make the lighting circuits within the lighting cells electrically connected in both a parallel connection and a series connection.

* * * * *